United States Patent [19]

Ramaiah

[11] Patent Number: 4,950,938

[45] Date of Patent: Aug. 21, 1990

[54] DISCHARGE LAMP WITH DISCHARGE VESSEL RUPTURE SHIELD

[75] Inventor: Raghu Ramaiah, Painted Post, N.Y.

[73] Assignee: North American Philips Corp., New York, N.Y.

[21] Appl. No.: 272,181

[22] Filed: Nov. 16, 1988

[51] Int. Cl.[5] ..... H01J 61/34

[52] U.S. Cl. ..... 313/25; 313/634

[58] Field of Search ..... 313/25, 580, 634, 635; 362/186, 185

[56] References Cited

U.S. PATENT DOCUMENTS 314,208 3/1885 White ..... 313/113 X
4,625,141 11/1986 Keeffe et al. ..... 313/25
4,678,960 7/1987 Reiling ..... 313/25
4,721,876 1/1988 White et al. ..... 313/25

FOREIGN PATENT DOCUMENTS 306269 3/1989 European Pat. Off. .

*Primary Examiner*—Kenneth Wieder
*Attorney, Agent, or Firm*—Emmanuel J. Lobato

[57] ABSTRACT

A high-pressure discharge lamp having an internal metal shield for containing fragments in the event the lamp discharge vessel ruptures. The metal shield is mounted in an electrically isolated condition to avoid acceleration of sodium loss from the discharge vessel due to the proximity of the discharge vessel and the metal shield.

7 Claims, 1 Drawing Sheet

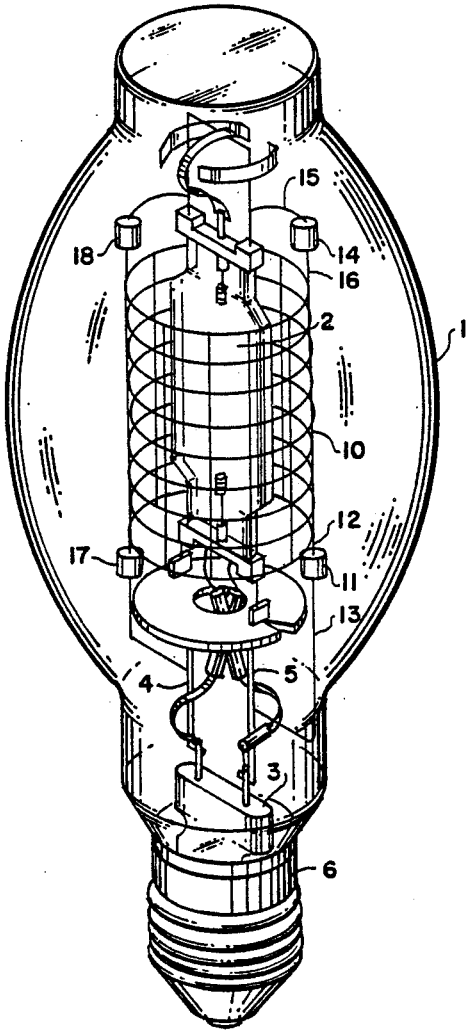
15
18
14
16
2
1
10
12
17
11
13
4
5
3
6

DISCHARGE LAMP WITH DISCHARGE VESSEL RUPTURE SHIELD

BACKGROUND OF THE INVENTION

The present invention relates to high-pressure discharge lamps, and more particularly metal halide high-pressure discharge lamps having structure for containing discharge vessel fragments in the event of discharge vessel rupture.

High-pressure discharge lamps which include a metal halide in the ionizable material are well known. These lamps typically have an ionizable material comprising mercury, a sodium halide and a metal halide contained within a discharge vessel. During lamp operation the ionizable material is vaporized and partially ionized by an electrical discharge through the vaporized material within the discharge vessel to emit light. Ultraviolet radiation is also produced by the discharge. The internal pressure within the discharge vessel is greater than one atmosphere and typically several atmospheres.

Because of the high internal pressure within the discharge vessel, care is taken to design the vessel to withstand such pressures. Notwithstanding good design practice applied to the discharge vessel, on occasion one may fail. If the discharge vessel ruptures the pressure differential to which fragments of the discharge vessel are subjected can accelerate the fragments with sufficient force to penetrate the lamp outer envelope.

One measure taken for preventing discharge vessel fragments from escaping the lamp has been to provide a transparent glass shield around the discharge vessel. U.S. Pat. No. 4,281,274 (Bechard et al) discloses such a lamp. This lamp comprises a typical quartz discharge vessel used in metal halide lamps, and a cylindrical sleeve axially aligned with the discharge vessel and surrounding it. The cylindrical sleeve is a borosilicate hardglass. The patent discloses that the hard glass sleeve performs three functions: temperature control, fragment containment and ultraviolet radiation shielding. The patent describes experimental evidence that the hard glass cylindrical shield must be positively biased in order to minimize the loss of sodium from the discharge vessel.

British patent specification 495,978 accepted Nov. 23, 1938 (based on application No. 16451/37 dated June 14, 1937) also shows the use of a thick auxiliary glass jacket to provide rupture protection in a high pressure metal vapor discharge lamp. No mention is made as to how the auxiliary glass jacket might affect sodium loss from the lamp discharge vessel.

Another containment technique in the event of discharge vessel failure is the use of a wire mesh surrounding the discharge vessel. A lamp utilizing this technique is disclosed in German patent document No. P6118 D published Mar. 5, 1953 (Ulrich W. Doering). This patent document discloses an ultraviolet lamp having a discharge vessel which is not housed within an outer lamp envelope. In order to contain discharge vessel fragments in the event of a rupture, a cylindrical wire mesh body is mounted surrounding the discharge vessel. The lamp is evidently a high-pressure mercury vapor lamp, and there is no concern for the problem of sodium loss and how that might be affected by the wire mesh.

The use of a wire mesh containment shield is also disclosed in U.S. Pat. No. 4,625,140 (Gagnon). This patent discloses a tungsten halogen lamp comprised of an inner light source capsule and an outer lamp envelope. The inner light source capsule is actually a tungsten halogen lamp which operates at high temperature and high internal pressure. The tungsten halogen lamp does not contain sodium, and there is no consideration of how the wire mesh might affect sodium loss if used in a metal halide lamp.

Metal shields show promise in providing effective and reliable protection against discharge vessels ruptures in electric lamps. However, ultraviolet radiation incident on a metal shield will cause the emission of photoelectrons from the metal. These photoelectrons can collect on the lamp discharge vessel to impart a negative charge to it and accelerate the diffusion of positive sodium atoms through the discharge vessel wall. Before a metal shield can be incorporated in discharge lamps that contain sodium, such as metal halide lamps, measures must be taken to avoid exacerbating the sodium loss problem by the incorporation of a metal shield within the lamp outer envelope.

Accordingly, an object of the invention is to provide a practicable metal halide discharge lamp having an internal metal shield for the discharge vessel in a manner that does not accelerate sodium loss so as to diminish lamp performance.

SUMMARY OF THE INVENTION

In a metal halide discharge lamp according to the invention, a quartz discharge vessel is mounted within an outer lamp envelope. The discharge vessel contains an ionizable fill material comprising mercury, a sodium halide and a metal halide. Means for ionizing the fill material within the discharge vessel permits ionization of the fill material to emit light. The ionized fill material develops a pressure within the discharge vessel exceeding one atmosphere.

A metal shield is mounted within the outer lamp envelope and at least partially surrounds the discharge vessel. The metal shield has a plurality of openings to permit light emitted from the discharge vessel to pass through it and has a mechanical strength sufficient to contain discharge vessel fragments in the event the discharge vessel ruptures during lamp operation. Mounting means is provided for mounting the metal shield in an electrically isolated condition within the outer lamp envelope and positioned partially surrounding the discharge vessel. When the metal shield is mounted in the electrically isolated condition no substantial acceleration in sodium loss from the discharge vessel is encountered because of the presence of the metal shield.

BRIEF DESCRIPTION OF THE DRAWINGS

The sole figure of the drawing illustrates a metal halide discharge lamp having an internal metal shield mounted in accordance with the present invention.

DETAILED DESCRIPTION OF THE INVENTION

A metal halide discharge lamp according to the invention is comprised of an outer envelope 1 containing a quartz discharge vessel 2. The outer lamp envelope 1 is closed by a press seal 3 having conductive supports 4 and 5 embedded in it. The discharge vessel 2 is mounted on the conductive supports 4 and 5 in a conventional manner, and the conductive supports are in turn connected to respective contacts of the lamp base 6. A lamp operating voltage is applied to the lamp base 6 contacts and through the conductive supports 4 and 5 for energizing the discharge vessel to emit light. The structure described so far and its operation is conventional.

During normal lamp operation the discharge vessel 2 typically develops high internal pressures of several atmospheres. If the discharge vessel fails the high internal pressure will outwardly accelerate hot fragments of the discharge vessel, and the velocity of the fragments will be sufficient to penetrate the outer lamp envelope 1. A perforated metal shield 10 is provided in order to contain discharge vessel fragments wholly within the lamp outer envelope 1.

The perforated metal shield 10 is mounted so as to be electrically isolated from the rest of the lamp structure. The shield mounting structure is comprised of glass bodies 11 and 14 each having embedded therein a pair of wires. The wires 12 and 13 do not touch within the glass body 11 and consequently they are electrically insulated from each other but mechanically connected by the glass body 11. The wire 12 is welded to the perforated metal shield 10 at its lower end, and the wire 13 is welded to the conductive support 5. This structure is effective for securing the lower end of the perforated metal shield 10. Similarly, the glass body 14 having embedded wires 15 and 16 is used for securing the upper end of the metal shield 10. The wire 15 is welded to the support conductor 5 and the wire 16 is welded to the metal shield 10. This secures the upper end of the metal shield 10. A second pair of glass bodies 17, 18 with embedded wires are provided for additional support, and have identical structure to glass bodies 11, 14.

The structure for mounting the metal shield 10 in an electrically isolated condition is a critical feature of the lamp according to the invention. Contrary to the predictions of the prior art, it has been found that sodium loss from the discharge vessel 2 is not accelerated by the presence of the metal shield 10 when it is maintained electrically isolated. The absence of a positive electrical bias applied to the metal shield 10, in the manner taught in U.S. Pat. No. 4,281,274 with a hardglass shield, is no detriment to lamp performance. On the contrary, lamps with the electrically isolated metal shield 10 performed better than lamps with no shield at all, notwithstanding that the metal shield 10 should have been an abundant source of photoelectrons.

The absence of sodium loss acceleration in the presence of the perforated metal shield is demonstrated by the data presented in Table I below. Four sets of conventional 400 watt metal halide lamps were made. One set of standard lamps used as controls had no metal shield around the discharge vessel. A second set of lamps had a perforated metal shield mounted in an electrically isolated condition in the manner described above. The third and fourth sets of lamps likewise had a perforated metal shield mounted as described, but in these lamps circuit elements were provided for positively biasing the metal shield during lamp operation.

In the lamps identified in the column Positive Bias I, a diode was connected between one of the conductive supports 4, 5 and the perforated metal shield. The anode of the diode was connected to the metal shield so as to apply a positive potential to the metal shield during one half cycle of lamp operation. The lamps identified under the column Positive Bias II had a similarly connected diode between one of the conductive supports and the metal shield, and a 28 kiloohm resistor connected between the metal shield and the other conductive support. In this arrangement, not only was a positive potential applied during alternate half cycles of lamp operation, but a current flowed through the metal shield during that half cycle.

In Table I, N is the number of lamps under test at a particular operating time, LV is the average lamp voltage (in volts) for those lamps, and M is the average maintenance (in percent) for those lamps relative to the lumen output of the lamps at 100 hours.

TABLE I

| Operating | Controls | | | Isolate Shield | | | Positive Bias I | | | Positive Bias II | | |
|---|---|---|---|---|---|---|---|---|---|---|---|---|
| Time (hrs) | N | LV | M | N | LV | M | N | LV | M | N | LV | M |
| 100 | 5 | 130.8 | — | 5 | 129.1 | — | 4 | 129.8 | — | 3 | 130.4 | — |
| 1000 | 5 | 132.6 | 89.0 | 4 | 130.0 | 92.0 | 2 | 144.5 | 44.0 | 3 | 151.0 | 58.0 |
| 2000 | 5 | 134.5 | 86.0 | 3 | 132.4 | 89.3 | | | | | | |
| 7500 | 5 | 137.6 | 76.1 | 3 | 134.6 | 75.5 | | | | | | |
| 10,000 | 5 | 141.8 | 57.0 | 3 | 136.0 | 59.0 | | | | | | |

A comparison of the data for the control lamps and the lamps with the isolated shield shows that during 10,000 hours of lamp operation the lamp voltage of the lamps having isolated shields rises no faster than the control lamps. In fact, in the lamps tested with the isolated shield, the lamp voltage rose slightly less than the control lamps.

Because the increase in lamp voltage is attributable in large part to the loss of sodium during lamp operation, the absence of a greater voltage increase in the lamps with the isolated shield is substantial evidence that the isolated shield does not accelerate sodium loss. In fact, the lower voltage values in the case of lamps with isolated shields would indicate a lower rate of sodium loss than in the control lamps. The apparent mechanism for a lowered sodium loss rate is a static positive potential developed on the isolated metal shield 10 and a resulting diminution in photoelectron production. With each photoelectron ejected from the isolated metal shield 10 the shield acquires one positive electronic charge. Because the metal shield is isolated the acquired positive charges accumulate until the shield potential is just sufficient to prevent any further ejection of photoelectrons. When this condition is reached no further photoelectrons should be produced from the metal shield 10 in response to ultraviolet radiation from the lamp discharge, except to the extent that imperfect electrical isolation of the metal shield 10 allows some loss of positive charge. In this case the photoelectron flux should be low; just enough to balance the loss of positive charge from the metal shield. Electrical potentials as high as +52 volts were measured on the isolated metal shield 10 of a metal halide lamp according to the invention and confirm the existence of the mechanism just described.

Both positive biasing arrangements resulted in substantially greater voltage increases than in the case of the control lamps. Although the average lamp voltage for all of the lamps at 100 hours was around 130 volts, the lamp voltage of the positively biased lamps had risen to 145 to 150 volts after only 1,000 hours of operation. The average voltage of the control lamps was less than 133 volts. The positive biasing arrangements used were insufficient to prevent a substantial acceleration in sodium loss with the perforated metal shield positioned around the discharge vessel.

The perforated shield used in the lamps described above was a steel mesh having a 38% open area. The purpose of the tests was to investigate the control of sodium loss, and there was no attempt to investigate the maximum open area that would be practicable.

The following Table II shows data for mesh shields made from different diameter wires. Meshes having in excess of 90% open area are readily feasible, and if stainless steel wire is used the mesh will be somewhat reflective. Consequently, the possibility of limiting light attenuation caused by the interposition of the mesh around the discharge vessel to about 10% appears feasible.

TABLE II

| Wire Diameter (in) | Wire Spacing (in.) | % Open Area |
|---|---|---|
| 0.010 | 0.225 | 92 |
| 0.009 | 0.225 | 93 |
| 0.007 | 0.225 | 94 |
| 0.007 | 0.300 | 96 |
| 0.006 | 0.161 | 93 |

The perforated shield disclosed in the drawing is generally cylindrical and has open ends. One of the lamps according to the invention was caused to fail by applying a high voltage pulse to it. The steel mesh contained all of the discharge vessel fragments, and the outer envelope remained intact. Closed shield ends appear unnecessary for the elongate discharge vessel tested; however, for discharge vessels of other shapes a perforated screen that completely surrounds the discharge vessel might be used. Accordingly, the particular embodiment of the invention shown in the drawing is merely illustrative and the scope of the invention is determined by the following claims.

What is claimed is:

1. In a high-pressure metal halide discharge lamp of the type having an outer envelope, a quartz discharge vessel within said outer envelope, an ionizable fill material within said discharge vessel comprising mercury, sodium and a metal halide, and means for ionizing said fill material within said discharge vessel to emit light wherein said fill material develops a pressure within said discharge vessel in excess of one atmosphere; the improvement comprising:

a perforated metal shield within said outer lamp envelope at least partially surrounding said discharge vessel, having a plurality of openings to permit light emitted from said discharge vessel to pass therethrough and having a mechanical strength sufficient to contain discharge vessel fragments in the event said discharge vessel rupture during lamp operation; and mounting means for mounting said metal shield in an electrically isolated condition within said outer lamp envelope and positioned partially surrounding said discharge vessel, and said mounting means being effective to mount said metal shield sufficiently electrically isolated to suppress a rise in lamp operating voltage which will occur over the operating life of the lamp.

2. In a high-pressure metal halide discharge lamp according to claim 1, wherein said discharge vessel is elongate and tubular having press sealed ends of relatively greater wall thickness and side walls of relatively less wall thickness, and said metal shield is a metal cylindrical body positioned surrounding the sides of said discharge vessel.

3. In a high-pressure metal halide discharge lamp according to claim 2, wherein said metal cylindrical body is comprised of a metal mesh having a length equal to at least the distance between the press seals of said discharge vessel and continuously circumscribing said discharge vessel; and said mounting means comprising a plurality of electrically insulative supports for supporting respective ends of said metal cylindrical body, each of said electrically insulative supports comprising a glass block having a pair of wires embedded therein and emerging from respective ends of said glass block, wherein said pair of wires embedded in said glass block are unconnected and electrically insulated from each other, one of said wires being connected to said metal cylindrical body at one end thereof and the other of said wires being connected to internal structure of said lamp for mounting said metal cylindrical body.

4. In a high-pressure metal halide discharge lamp according to claim 2, wherein said metal cylindrical body is comprised of a cut screen.

5. In a metal halide discharge lamp having a discharge vessel through which sodium ions can diffuse during lamp operation, and an ionizable material comprising sodium within said discharge vessel, the improvement comprising:

a perforated metal shield at least partially surrounding said discharge vessel, having a plurality of openings to permit light emitted from said discharge vessel to pass therethrough and having a mechanical strength sufficient to contain discharge vessel fragments in the event said discharge vessel ruptures during lamp operation; and mounting means for mounting said metal shield positioned partially surrounding said discharge vessel and in an electrically isolated condition to permit a stable positive potential to be developed on said metal shield during lamp operation sufficient to suppress photoelectron production, whereby the presence of said metal shield does not promote sodium loss from said discharge vessel.

6. In a high-pressure metal halide discharge lamp according to claim 5, wherein said discharge vessel is elongate and tubular having press sealed ends of relatively greater wall thickness and side walls of relatively less wall thickness, and said metal shield is a metal cylindrical body positioned surrounding the sides of said discharge vessel.

7. In a high-pressure metal halide discharge lamp according to claim 6, wherein said metal cylindrical body is comprised of a metal mesh having a length equal to at least the distance between the press seals of said discharge vessel and continuously circumscribing said discharge vessel; and said mounting means comprising a plurality of electrically insulative supports for supporting respective ends of said metal cylindrical body, each of said electrically insulative supports comprising a glass block having a pair of wires embedded therein and emerging from respective ends of said glass block, wherein said pair of wires embedded in said glass block are unconnected and electrically insulated from each other, one of said wires being connected to said metal cylindrical body at one end thereof and the other of said wires being connected to internal structure of said lamp for mounting said metal cylindrical body.

* * * * *